US009550607B2

(12) United States Patent
Vietz et al.

(10) Patent No.: US 9,550,607 B2
(45) Date of Patent: Jan. 24, 2017

(54) PACKING POLYCRYSTALLINE SILICON

(71) Applicant: Wacker Chemie AG, Munich (DE)

(72) Inventors: Matthias Vietz, Mattighofen (AT); Bruno Lichtenegger, Emmerting (DE); Reiner Pech, Neuoetting (DE)

(73) Assignee: Wacker Chemie AG, Munich (DE)

( * ) Notice: Subject to any disclaimer, the term of this patent is extended or adjusted under 35 U.S.C. 154(b) by 558 days.

(21) Appl. No.: 14/095,296

(22) Filed: Dec. 3, 2013

(65) Prior Publication Data

US 2014/0165503 A1 Jun. 19, 2014

(30) Foreign Application Priority Data

Dec. 14, 2012 (DE) ..... 10 2012 223 192

(51) Int. Cl.

| | |
|---|---|
| ***B65D 30/00*** | (2006.01) |
| ***B65B 1/28*** | (2006.01) |
| ***B65B 25/00*** | (2006.01) |
| ***B65B 29/00*** | (2006.01) |
| ***B65B 31/04*** | (2006.01) |
| ***B65B 51/14*** | (2006.01) |
| ***B65B 5/06*** | (2006.01) |

(52) U.S. Cl.

CPC ..... *B65D 29/00* (2013.01); *B65B 1/28* (2013.01); *B65B 5/067* (2013.01); *B65B 25/00* (2013.01); *B65B 29/00* (2013.01); *B65B 31/04* (2013.01); *B65B 51/146* (2013.01)

(58) Field of Classification Search

CPC ..... B65D 29/00; B65B 1/28; B65B 5/067; B65B 25/00; B65B 29/00; B65B 31/04; B65B 51/146

See application file for complete search history.

(56) References Cited

U.S. PATENT DOCUMENTS

| | | | | |
|---|---|---|---|---|
| 4,681,228 | A * | 7/1987 | Kerry | B65D 75/38 206/484 |
| 4,964,259 | A * | 10/1990 | Ylvisaker | B65B 9/213 53/374.8 |
| 5,855,232 | A * | 1/1999 | Oda | B65B 1/28 141/364 |
| 8,707,660 | B2 * | 4/2014 | Howes | B65B 9/04 53/170 |
| 2005/0034430 | A1 * | 2/2005 | Holzlwimmer | B65B 1/32 53/469 |
| 2010/0154357 | A1 | 6/2010 | Wochner | |
| 2012/0198793 | A1 | 8/2012 | Hoelzlwimmer | |

FOREIGN PATENT DOCUMENTS

| | | | |
|---|---|---|---|
| DE | 102005024584 | A1 | 11/2006 |
| EP | 1334907 | A1 | 8/2003 |
| EP | 2030905 | A2 | 3/2009 |

OTHER PUBLICATIONS

PatBase abstract for DE 10 2005 024 584.

* cited by examiner

*Primary Examiner* — Chun Cheung
(74) *Attorney, Agent, or Firm* — Caesar Rivise, PC

(57) ABSTRACT

The present invention relates to a method for packing polysilicon in the form of chunks by introducing the chunks into a first plastic bag, the first plastic bag being introduced into a second plastic bag after the introduction of the chunks, or the first plastic bag already having been inserted into the second plastic bag prior to the introduction of the chunks into the first plastic bag, as a result of which the chunks are present in a double bag which is sealed, wherein the air present in the two plastic bags in the double bag after the introduction of the chunks is removed before the sealing of the double bag such that the total volume of the double bag relative to the volume of the chunks is 2.4 to 3.0.

15 Claims, No Drawings

PACKING POLYCRYSTALLINE SILICON

BACKGROUND OF THE INVENTION

The invention relates to a method for packing polycrystalline silicon.

Polycrystalline silicon (polysilicon) is predominantly deposited from halosilanes such as trichlorosilane by means of the Siemens process, and then comminuted with minimum contamination into polycrystalline silicon chunks.

For applications in the semiconductor and solar industries, chunk polysilicon with a minimum level of contamination is desirable. Therefore, the material should also be packed with a low contamination level before it is transported to the customer.

Typically, chunk polysilicon is packed in plastic bags.

Chunk polysilicon is a sharp-edged, non-free-flowing bulk material. Therefore, in the course of packing, it has to be ensured that the material does not penetrate the customary plastic bags in the course of filling, or in the worst case, even completely destroys them. In order to avoid this, the prior art proposes various measures. US 2010/154357 A1, for example, envisages an energy absorber within the plastic bag.

However, such penetration of the bag can occur not just during packing but also in the course of transport to the customer. Chunk polysilicon is sharp-edged, and so, in the case of unfavorable orientation of the chunks in the bag, relative movement of the chunks with respect to the bag film can result in their cutting through it, or pressure of the chunks on the bag film can result in their penetrating it.

Chunks protruding from the bag packing can become unacceptably contaminated directly by surrounding materials and inner chunks by inflow of ambient air.

In addition, when packed silicon chunks are transported, there is unwanted post-comminution.

This is undesirable especially because the fines fraction which forms has been shown to lead to poorer operating performance for the customers. The result of this is that the fines fraction has to be sieved off again before further processing by the customer, which is disadvantageous.

This problem applies equally to crushed and classified, and to cleaned and uncleaned silicon, irrespective of the size of the package (typically bags containing 5 or 10 kg of polysilicon).

US 2010/154357 A1 proposes sucking the air out of the bag during sealing until a vacuum of 10 to 700 mbar arises.

US 2012/198793 A1 discloses sucking the air out of the bag before welding until a flat bag with a low air content arises.

These measures are unsuitable for preventing penetration.

This gave rise to the objective of the invention.

DESCRIPTION OF THE INVENTION

The object is achieved by a method for packing polysilicon in the form of chunks by introducing the chunks into a first plastic bag, the first plastic bag being introduced into a second plastic bag after the introduction of the chunks, or the first plastic bag already having been inserted into the second plastic bag prior to the introduction of the chunks into the first plastic bag, as a result of which the chunks are present in a double bag which is sealed, wherein the air present in the two plastic bags in the double bag after the introduction of the chunks is removed before the sealing of the double bag such that the total volume of the double bag relative to the volume of the chunks is 2.4 to 3.0.

Preferably, each of the two plastic bags in the double bag is sealed separately by welding after the removal of air. It is equally preferable to seal the two plastic bags in the double bag by welding by means of a common weld seam.

Preferably, the introduction of chunks into the first plastic bag is followed by removal of air from the first plastic bag, by sealing of the first plastic bag and introduction into the second plastic bag, so as to give rise to the double bag, and then by removal of air from the second plastic bag and sealing thereof.

The object is also achieved by a double bag comprising a first and a second plastic bag and polysilicon in the form of chunks present in the first plastic bag, wherein the first plastic bag has been inserted into the second plastic bag, wherein both plastic bags have been sealed, wherein the total volume of the double bag relative to the volume of the chunks is 2.4 to 3.0.

Preferably, the total volume of the first bag relative to the volume of the chunks is 2.0 to 2.7.

Preferably, the dimensions of the first bag are such that the plastic films fit close to the silicon chunks. As a result, it is possible to avoid relative movements between the chunks.

The plastic bags preferably consist of a high-purity plastic. This is preferably polyethylene (PE), polyethylene terephthalate (PET) or polypropylene (PP) or composite films. A composite film is a multilayer packing film from which flexible packages are made. The individual film layers are typically extruded or laminated.

The plastic bag preferably has a thickness of 10 to 1000 μm.

The plastic bags can be sealed, for example, by means of welding, bonding, sewing or positive locking. It is preferably effected by means of welding.

In order to determine the volume of the packed bag, it is dipped into a water basin.

The displaced water corresponds to the total volume of the bag (Vtot).

Using the weight of the silicon, with the constant density of ultrapure silicon (2.336 g/cm$^3$), the volume of the silicon (Vsi) was determined.

Alternatively, the volume of the silicon could likewise be determined via the dipping method.

Table 1 shows the ratio $V_{tot}/V_{si}$ and the qualitative results with regard to penetration and fines production for packages without air suction, for a package according to the prior art as per US 2010/154357 A1 and for two bags packed in a simple way.

Penetration of the packing film and formation of unwanted fines were determined after a standardized transport simulation (truck/train/ship).

Bag 1 was filled with chunks of size 4-15 mm.

Bag 2 was filled with chunks of size 45-120 mm.

The size class is defined as the longest distance between two points on the surface of a silicon chunk (=max. length).

TABLE 1

| | $V_{tot}/V_{Si}$ | Penetration | Fines fraction |
|---|---|---|---|
| No air suction | >2.8 | frequent | large |
| US2010/154357 A1 | <1.8 | frequent | large |
| Bag 1 | 2.18-2.31 | no | no |
| Bag 2 | 2.00-2.69 | barely any | no |

Bags 1 and 2 were welded into a second bag in a further test (double bag).

Table 2 shows the ratio $V_{tot}/V_{si}$ and the qualitative results with regard to penetration and fines production for double bag packages without air suction, and for two inventive examples.

TABLE 2

| | $V_{tot}/V_{si}$ | Penetration | Fines fraction |
|---|---|---|---|
| Without air suction | >3.4 | frequent | large |
| Example 1 | 2.45-2.75 | no | no |
| Example 2 | 2.45-2.95 | no | no |

For the primary bag, the aim is to obtain a ratio $V_{tot}/V_{si}$ of 2.0 to 2.7, preferably of 2.0 to 2.4.

It is thus surprisingly possible to produce a fines—and penetration-free package.

For the silicon packed into inner and outer bags, $V_{tot}/V_{si}$ of 2.40 to 3.0 is essential.

The air can be removed from a silicon-filled plastic bag by various methods:

manual pressing and subsequent welding
clamp or ram device and subsequent welding
suction device and subsequent welding
vacuum chamber and subsequent welding The ambient conditions in the course of packing are preferably a temperature of 18-25° C. The relative air humidity is preferably 30-70%.

It has been found that condensation water formation can be avoided as a result.

Preferably, the packing additionally takes place in the environment of filtered air.

What is claimed is:

1. A method for packing polysilicon in a form of chunks, said method comprising:

(a) introducing the chunks into a first plastic bag, wherein the first plastic bag is introduced into a second plastic bag after the introducing of the chunks, or the first plastic bag has been inserted into the second plastic bag prior to the introducing of the chunks into the first plastic bag, as a result of which the chunks are present in a double bag;

(b) removing air from the double bag after the introducing of the chunks and before sealing the double bag such that a total volume of the first plastic bag relative to the volume of the chunks is 2.0 to 2.7 and a total volume of the double bag relative to the volume of the chunks is 2.4 to 3.0.

2. The method as claimed in claim 1, wherein dimensions of the first plastic bag are such that a plastic film of the first plastic bag fits close to the chunks.

3. The method as claimed in claim 1, wherein air is removed from the plastic bags by compressing the plastic bags with a clamp, a ram device, a suction device or a vacuum chamber.

4. The method as claimed in claim 1, wherein a relative air humidity during the method is 30-70%.

5. The method as claimed in claim 1, wherein each of the two plastic bags in the double bag is sealed separately by welding after the air removing.

6. The method as claimed in claim 1, wherein the two plastic bags in the double bag are sealed by welding with a common weld seam.

7. The method as claimed in claim 1, wherein the introducing of the chunks into the first plastic bag is followed by removal of air from the first plastic bag, by sealing of the first plastic bag and introduction into the second plastic bag, so as to give rise to the double bag, and then by removal of air from the second plastic bag and sealing thereof.

8. The method as claimed in claim 1, wherein dimensions of the first plastic bag are such that a plastic film of the first plastic bag fits close to the chunks.

9. The method as claimed in claim 8, wherein air is removed from the plastic bags by compressing the plastic bags with a clamp, a ram device, a suction device or a vacuum chamber.

10. The method as claimed in claim 9, wherein a relative air humidity during the method is 30-70%.

11. The method as claimed in claim 10, wherein each of the two plastic bags in the double bag is sealed separately by welding after the air removing.

12. The method as claimed in claim 11, wherein the two plastic bags in the double bag are sealed by welding with a common weld seam.

13. The method as claimed in claim 12, wherein the introducing of the chunks into the first plastic bag is followed by removal of air from the first plastic bag, by sealing of the first plastic bag and introduction into the second plastic bag, so as to give rise to the double bag, and then by removal of air from the second plastic bag and sealing thereof.

14. A double bag, comprising a first and a second plastic bag and polysilicon in a form of chunks present in the first plastic bag, wherein the first plastic bag is positioned within the second plastic bag, both plastic bags are sealed, wherein a total volume of the first bag relative to the volume of the chunks is 2.0 to 2.7 and a total volume of the double bag relative to the volume of the chunks is 2.4 to 3.0.

15. The double bag as claimed in claim 14, wherein the first and the second plastic bags are sealed by welding and have a common weld seam.

* * * * *